US006705837B1

(12) United States Patent
Walker

(10) Patent No.: US 6,705,837 B1
(45) Date of Patent: Mar. 16, 2004

(54) WELDED CONNECTOR FOR BLADE LINER

(75) Inventor: Robert Alexander Walker, Galston Ayrshire (GB)

(73) Assignee: Howden Power Limited (IE)

( * ) Notice: Subject to any disclaimer, the term of this patent is extended or adjusted under 35 U.S.C. 154(b) by 25 days.

(21) Appl. No.: 10/070,171

(22) PCT Filed: Sep. 7, 2000

(86) PCT No.: PCT/GB00/03433

§ 371 (c)(1),
(2), (4) Date: Apr. 18, 2002

(87) PCT Pub. No.: WO01/18402

PCT Pub. Date: Mar. 15, 2001

(30) Foreign Application Priority Data

Sep. 7, 1999 (GB) ..... 9921140

(51) Int. Cl.[7] ..... F01D 5/14
(52) U.S. Cl. ..... 416/224; 416/229 R; 416/184
(58) Field of Search ..... 416/224, 229 R, 416/241 R, 184, 233, 134, 182–186 R; 415/98; 411/537, 538, 222

(56) References Cited

U.S. PATENT DOCUMENTS 1,217,386 A * 2/1917 Banner
1,233,115 A * 7/1917 Osborne
2,178,728 A * 11/1939 Schneible
3,319,383 A * 5/1967 Bowling, Jr. et al.
3,660,943 A * 5/1972 Barnthouse ..... 51/9
6,004,097 A * 12/1999 Wark et al. ..... 415/206

* cited by examiner

*Primary Examiner*—Edward K. Look
*Assistant Examiner*—J. M. McAleenan
(74) *Attorney, Agent, or Firm*—McNair Law Firm, P.A.

(57) ABSTRACT

A connector sleeve 17 secured to the backing plate 7*a* of a wear-resistant liner 7 facilitates attachment of the liner 7 to the body9 of a rotor blade by virtue of welding of a thrust collar 20 to a portion of the connector sleeve 17 projecting past a bore 18 in the blade body 9. Removal of the liner later for replacement is possible by burning off the welds connecting the thrust collar to the connector sleeve. A clamping tool 22 comprising a tubular body 23 and a bolt 24 can be used to hold the thrust collar firmly against the back of the blade body 9 during the welding operation.

6 Claims, 3 Drawing Sheets

WELDED CONNECTOR FOR BLADE LINER

FIELD OF THE INVENTION

The present invention relates to a fluid machine having a bladed rotor.

BACKGROUND OF THE INVENTION

When a fluid machine is used in conjunction with a fluid which has erosion characteristics and is therefore likely to wear the surface of the fluid dynamic blade or other surface of the rotor or impeller, it had been known to provide a liner of erosion-resistant material and to attach it to the blade or other fluid dynamic surface of the rotor in order to lengthen the service life of that rotor.

The nature of such wear-resistant liners can be varied and can range from, on the one hand, the use of thin plain mild steel liners attached at localised areas to extensive cover with liners which are coated with an extremely hard wear-resistant material such as tungsten carbide or chromium carbide. The localised plain mild steel type of liner is relatively inexpensive and can be fitted easily. The more extensive liner coated with wear-resistant material tends to be much heavier than the localised thin plain mild steel liner so it can add considerably to the cost and complexity of the rotor or impeller and, due to the unacceptability of welding such hard coated surface material directly to the structural parts of the rotor or impeller, presents additional problems.

The hard-surfaced liner of the blade of the rotor or impeller is particularly difficult to fit, especially in the case of centrifugal impellers, due to fact that the attachment system must be capable of both carrying the centrifugal load induced by the rotating liner and of providing a sufficiently well distributed support to ensure that stresses and deflections within the liner are kept to acceptable limits, even when the rotor is rotating at high speed. It is therefore necessary to ensure that any attachment system does not compromise the structural integrity of the blade as a whole. Such a liner is available in a range of thicknesses which will therefore allow the minimising of the increase in the weight of the rotor or impeller due to the presence of the liner. With such a system there is a relatively high incidence of failure due to the inherent difficulty in reliably attaching such materials to the bladed surface and at the same time causing them to adapt to the shape of the blade surface.

In order to satisfy both of these requirements it has become accepted practice for such liners to be purpose-made to the shape of the blade, and the resulting increase in cost, weight and complexity has had to be accepted. Additionally the requirement for a purpose made liner gives rise to some problems in procuring an adequate supply of the appropriately shaped liner, due to the specialised nature of the manufacture of the liner and to the limited number of potential supplies of such liner.

One prior art form of attachment of a wear-resistant liner relies on the attachment of countersunk bolts into the mild steel backing plate of the purpose made composite liner so as to have their heads entrapped beneath the hard material defining the wear-resistant surface. Such a system is shown in FIG. 3 to be described later.

Typically such a system would use M16 bolts and would require the mild steel backing plate of the liner to have a thickness of the order of 10 mm in order to accommodate the bolt head. Hence the proprietary types of wear resistant plate stock with a hard surface are not suitable for use in this application.

The purpose made liners are often curved and, if so, this curving is carried out prior to depositing the hard surface on the purpose made liner. The pre-formed backing plate is then held in a purpose made jig with all of the embedded countersunk bolts in position, and then the hard surface is laid over the mild steel backing plate to conceal the countersunk heads.

In some environments it may be necessary to provide a protection cup to shield the nut, and the protruding end of the bolt shank, from erosion, as shown in FIG. 3.

U.S. Pat No. 4,565,495 discloses a centrifugal fan having an armouring system comprising a wear resistant liner attached to each blade, for preventing erosion of the aerofoil blades of the fan.

Welding of the stud to the pre-formed liner, as shown in FIG. 4*a*, is well proven but because the studs need to be very short in relation to their diameter there is difficulty in assuring adequate alignment of the access of the stud shank, and misalignment of only a small fraction of a degree between the nut and the blade surface could result in bending stresses in the bolt shank which exceed the yield stress of the weld and result in detachment of the bolt from the hard surface. Furthermore, any cracks which might be induced in the weld as a result of this bending stress may not be easily detectable prior to start-up of the rotor and detachment of the entire liner may result.

An alternative system (FIG. 4*b*) of connecting the liner to the blade involves directly plug welding into a recess defined by a hole which is formed in the blade and then blanked off by the (mild steel) backing plate of the composite liner.

In the case of such a plug weld it is difficult to ensure adequate quality of the attachment because of the limited access for both the welding operation and any subsequent inspection operation. There is thus a high risk of weld defects and lack of adequate fusion of the weld. Although such welds can be commonly used successfully for the attachment of static liners where there is negligible induced service load and where the attachment integrity is not so critical, for a liner attached to a dynamic component such as the impeller or rotor blade the need arises for much more critical attachment and the ability to resist high induced service loads.

SUMMARY OF THE INVENTION

In order to avoid these disadvantages of the prior art systems it has been necessary to develop alternative methods of attachment of a hard-surfaced liner to a blade of a rotor or impeller so as to ensure that the strength of the attachment is adequate to resist induced stresses arising from both the centrifugal force on the rotating liner and the fluid dynamic forces on the liner/blade combination, and to do so without compromising the structural strength of the blade per se.

Accordingly, one aspect of the present invention provides a rotor for a fluid machine comprising a plurality of blades each provided with a wear-resistant liner attached thereto by welding, characterised in that the weld comprises at least two tack welds between a connector sleeve joined to the backing plate of the liner and a thrust sleeve engaging the rear face of the blade body and holding the thrust sleeve firmly against the rear face of the blade body.

A second aspect of the invention provides a method of connecting a wear-resistant liner to a rotor blade of a fluid machine comprising:- forming a plurality of bores in said rotor blade; attaching a plurality of connector sleeves to the liner at locations to come into register with said bores in the blade when the liner is attached to the blade; the liner being pre-formed to fit on the fluid dynamic surface of the blade; bringing the liner and the blade into engagement and placing a thrust collar around the projecting portion of the connecting sleeve at the rear (non-fluid dynamic) face of the blade; presenting a tubular clamping tool to said thrust collar and mounting it with respect to said connector sleeve so that the tool can be actuated to thrust the thrust collar firmly against the rear surface of the blade body; and applying tack welds between the connector sleeve and the thrust collar to hold the thrust collar in place relative to the connector sleeve, and finally removing the clamping tool from the connector sleeve.

DESCRIPTION OF THE DRAWINGS

In order that the present invention may more readily be understood the following description is given, merely by way of example, with reference to the accompanying drawings in which.

DETAILED DESCRIPTION

Figure 2:
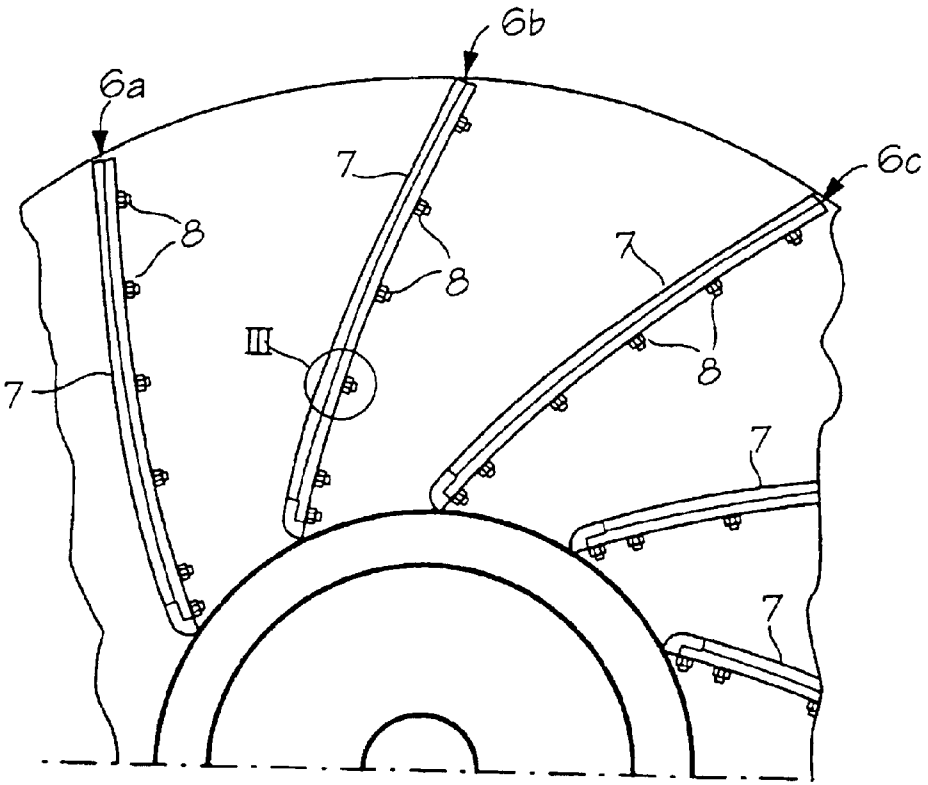
FIG. 2 is a view taken on the arrow II of FIG. 1.
Figure 1:
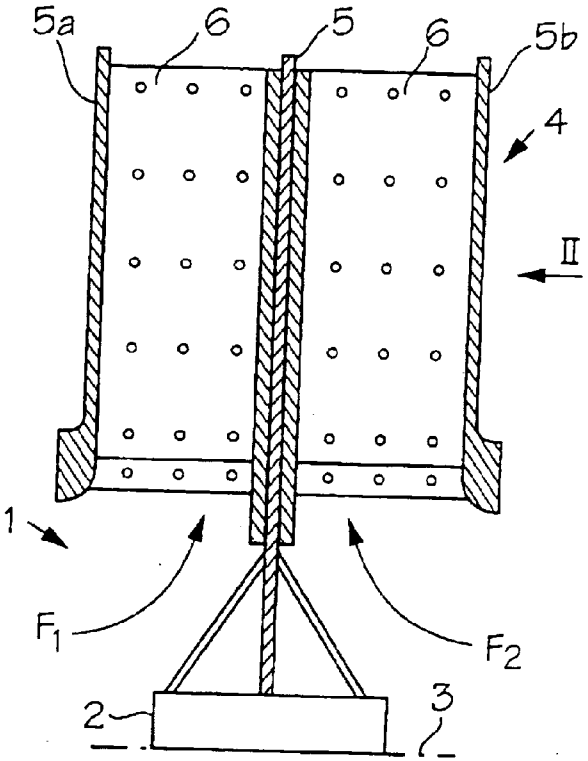
FIG. 1 is a section taken on a plane including the rotation axis and a radius of a rotor with a prior art attachment system used.

As mentioned above, FIG. 1 shows a prior art centrifugal rotor 1 having a hub 2 rotatable about an axis 3 and supporting an annular rotor body 4. A central plate 5 define s the median plane of the rotor and has blades 6 mounted to either side of it in a spiral configuration between it and a respective one of two side plates 5*a*, 5*b*, as shown in FIG. 2. Thus in operation of the rotor, which in this case is a centrifugal impeller, the air or other pumped fluid can enter from the right and the left flowing through the circular central opening of the respective side plate 5*a* or 5*b*, along paths shown by arrows $F_1$ and $F_2$, and towards the central plate 5. It is then deflected radially outwardly by the action of the rotating blades 6 (referenced 6*a*, 6*b*, 6*c* . . . etc. in FIG. 2).

When the air or other pumped fluid passing through the impeller exerts abrasive action on the blades 6, the blades need to be protected by erosion-resistant liners 7 which are attached by means of nuts on bolts 8 shown in FIG. 2.

Figure 3:
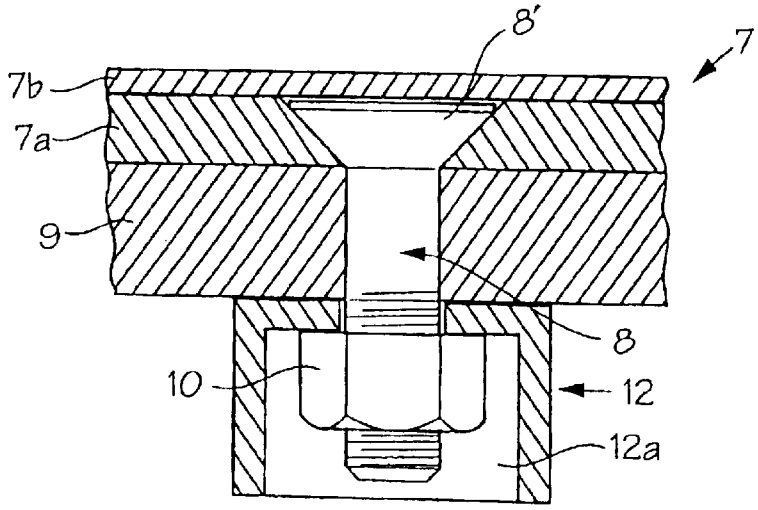
FIG. 3 is a detail of a first prior art method of attaching a hard-surfaced liner to a blade using countersunk headed screws.

FIG. 3 shows the body 9 of one of the blades 6 and illustrates that the liner 7 comprises a backing plate 7*a*, in this case of steel, having a wear-resistant layer 7*b*, in this case of tungsten carbide. The liner 7 wraps around the leading (radially inner) edge of the blade 6.

The bolt 8 is shown as having a countersunk head 8' which fits in a correspondingly countersunk bore in the backing plate 7*a* of the liner 7, this bore permitting the shank of the bolt to protrude to the side opposite that at which the liner is attached (the non-aerodynamic or hydrodynamic side of the blade). A nut 10, and optional corrosion protection cup 12 having an upstanding skirt 12*a* providing erosion protection for the nut 10, can then be attached to the shank in order to allow the bolt 8 to be later released from the blade 9, if desired, for removal of the liner 7.

Figure 4A:
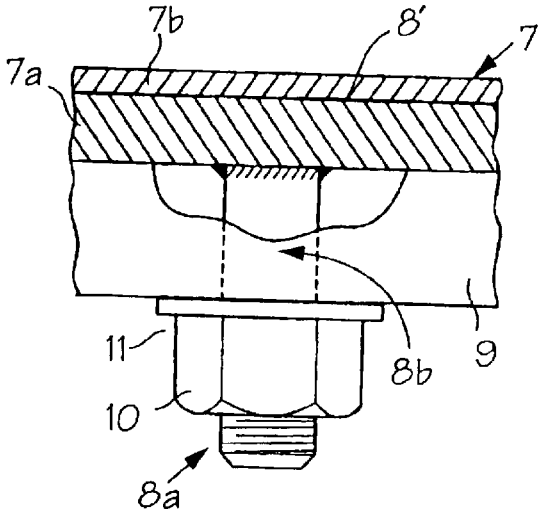
FIG. 4*a* is a detail showing a second prior art method of attaching a hard-surfaced liner to a blade using welded studs.

FIG. 4*a* shows a modification of the embodiment of FIG. 3, differing in that the bolt 8 is replaced by a stud 8*a* welded at 8*b* to the liner backing plate 7*a*, and in that a washer 11 is in this case used instead of the cup 12 of FIG. 3.

Figure 4B:
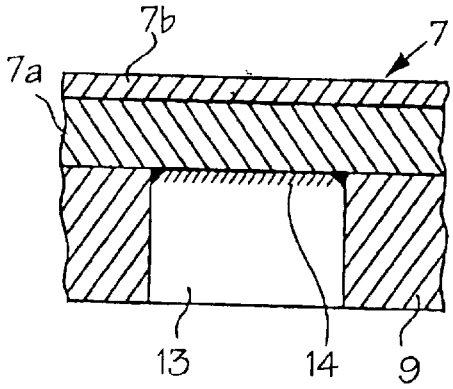
FIG. 4*b* is a detail showing an alternative system of attachment of a hard-surfaced liner to the blade using plug welding.

A further prior art embodiment is shown in FIG. 4*b* in that the liner 7 is attached to the blade body 9 by virtue of the backing plate 7*a* being placed over the aerodynamic or hydrodynamic surface of the blade and covering a hole 13 which has been formed in the blade 9. With the liner 7 clamped in position, a plug weld 14 is then formed in the base of a recess, which is defined by the hole 13 and blanked off by the backing plate 7*a*, with sufficient weld material to fuse to both the backing plate 7*a* and the body 9 of the blade.

The prior art embodiment of FIG. 4*a*, using welded studs, has the problem that the short length of stud makes it difficult to guarantee that it is perpendicular to the part of the backing plate 7*a* on which it is mounted, and any misalignment will place considerable strain on the weld between the stud 8*a* and the backing plate 7*a* when the nut 10 is tightened.

Likewise, the embodiment of FIG. 4*b* has a disadvantage that there is only a very confined space within the hole 13 which must be at least partially filled with the plug weld material 14 and this both restricts access for the welding operation and hinders access for any quality control inspection of the finished product.

Figure 5A:
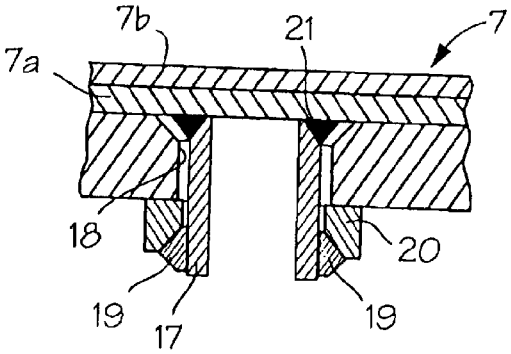
FIG. 5*a* is a sectional view of a connector in accordance with the present invention welded to the liner and holding the liner in place by virtue of being welded to a thrust collar bearing against the blade body.

FIG. 5*a* shows the connector in accordance with the present invention, already installed to clamp the liner 7 against the blade body 9 on the fluid dynamic (hydrodynamic or aerodynamic) surface of the blade 6.

The connector comprises an internally threaded sleeve 17 which fits with adequate clearance inside a bore 18 in the blade body 9 and has previously already been welded to the exposed face of the backing plate 7*a* of the liner 7.

As with the countersunk bolt of the embodiment of FIG. 3, this welding of the connector sleeve 17 to the backing plate 7*a* provides the liner with a plurality of pre-attached connectors which can then serve to hold the liner on the backing plate once those connectors (sleeves 17) have been threaded through the appropriate apertures (bores 18) in the blade body.

FIG. 5*a* shows that this welding operation has already been completed in that a weld 19 positions a thrust collar 20 in firm abutment against the rear (non-fluid dynamic) face of the blade body 9 so that the collar abuts the region around the bore 18 in the blade body.

FIG. 5*a* also shows the weld 21 which joins the connector sleeve 17 to the liner backing plate 7*a* and illustrates the fact that the bore 18 is countersunk so as to accommodate the bulk of the strip weld 21.

The thrust collar 20 is held firmly against the rear face of the blade body 9 during and after the welding operation. In the present embodiment this is achieved by use of a clamping tool 22 having a tubular body 23 whose end face becomes thrust against the thrust collar 20 when a bolt 24 within the sleeve is screwed into the corresponding internal thread of the connector sleeve 17. Bolt 24 also has a hexagonal head 24*a* which, together with spherical washers 25 between the head and the adjacent end of the tubular body 23 of the clamping tool 22, is capable of holding the tubular body 23 against the blade body 9 even in the event of there being misalignment of the axis of the connector sleeve 17 relative to the axis of the tubular body 23 when it sits firmly against the thrust collar 20.

This accommodation of misalignment is as a result of the spherical washer assembly 25. If a flat washer had been used then there would have been an uneven compressive load distribution around the washer when the bolt head 24 is drawn upwardly against it, but the fact that the washers have a spherical surface allows thin re-alignment to ensure uniform distribution of compression load despite any misalignment in the axis of the connector sleeve 17.

Figure 5B:
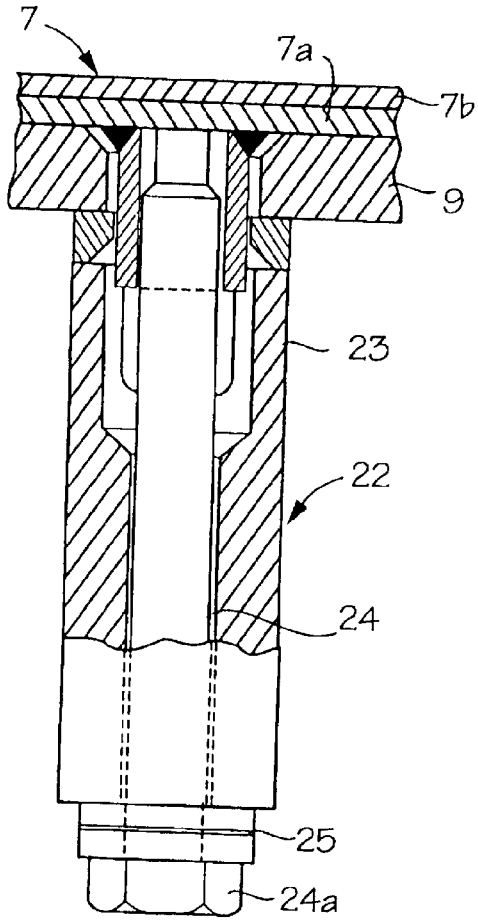
FIG. 5*b* is a view showing the connector of FIG. 5*a* during the installation process.
Figure 6:
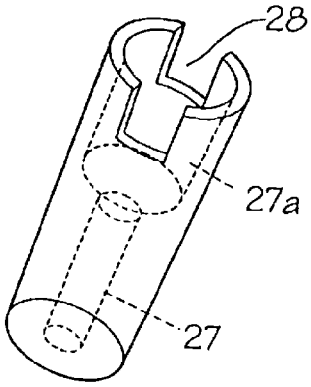
FIG. 6 is a view of the clamping tool for holding the collar firmly against the rear of the blade body during the welding operation.

The tubular body 23 of the clamping tool 22 is shown in perspective in FIG. 6 and comprises a through-bore 27 defining a recess to accommodate the shank of the bolt 24 and which opens out into a widened mouth portion 27*a* to accommodate the projecting end (lowermost in FIG. 5*a* and 5*b*) of the connector sleeve 17. At this same end of the tubular body 23 are two cut-away portions or slots 28, diametrically opposite one another, to allow access for welding to provide tack welds either forming part of an eventual continuous strip weld 19 (FIG. 5*a*) or forming welds which are themselves sufficiently strong at these diametrically opposed regions of the connector sleeve 17 to hold the thrust collar 18 under all service loads to which the blade/liner combination is going to be subjected in use.

The process of assembling the liner 7 to the blade body 9 is as follows:

Firstly the liner 7 comprising the backing plate 7*a* and the wear-resistant layer 7*b* is pre-formed so as to match the curvature of the blade and to have a lip which extends round the leading edge (the radially innermost edge) of the blade 6 on the rotor. Next a plurality of connector sleeves 17 is attached, by strip welds 21, to the backing plate 7 at locations which will correspond to the bores 18 in the blade body 9 when the liner 7 and the blade body 9 are assembled together. As indicated above, any minor misalignment in the axis of the connector sleeve 17 with respect to the normal to the liner backing plate 7*a* can be tolerated in the later stages of this assembly operation.

Next the clamping tool 22 comprising the tubular body 23, the nut 24 and the spherical washers 25, is presented to the connector and the bolt 24 is screwed into the internally threaded connector sleeve 17 far enough to compress the washers 25 and to draw the tubular body 23 firmly against the thrust collar 20 to provide the required clamping load.

At this stage the location of the tack welds 19 (yet to be made) is exposed by the slots 28 so that the tack welds 19 can be made. Once this tack welding operation is complete the bolt 24 can be unscrewed from the connector sleeve 17 and the tool can be removed and used at the next connector to be welded.

If desired, the two diametrically opposite tack welds 19 formed in the step just described can be supplemented by the provision of a continuous strip weld around the periphery of the exposed end of the connector sleeve 17 so as to provide a more secure attachment of the thrust collar 20 to the connector sleeve 17. However, this more secure attachment will of course mean more difficult removal when, subsequently, the liner 7 is to be removed for replacement purposes.

As compared with the prior art welded stud method shown in FIG. 4, the present invention uses a method of connection which eliminates the risk (normally associated with welded studs) of inducing an unacceptable degree of bending stress at the connector to backing plate weld 8*b*. This is achieved by substituting a plain bore (i.e. non threaded) collar as the main retaining element instead of the nut which is normally used with externally threaded studs (FIG. 4*a*). The relative dimensions of the internal diameter of the collar 20 and the external diameter of the connector sleeve 17 are such as to ensure that there is sufficient clearance between these two elements to ensure that the end face of the collar 20 is able to fully abut against the underside of the blade without imposing bending on the connector sleeve 17. All that is now required is a means of inducing sufficient tensile load to the connector sleeve 17 to ensure an adequate clamping force between liner 7 and blade 9 together with some means of permanently locking this load within the system.

The former requirement is achieved by means of the purpose designed tool 22 which is shown in use on FIG. 5*b*. The essential features of this tool are that it provides the necessary clamping force between liner 7 and blade 9 while, simultaneously, locating the thrust collar 20 against the underside of the blade. There is further provision (18) within the tool 22 to allow access for partially welding the thrust collar 20 to the connector sleeve 17 whilst it is maintained under full clamping load by means of the tool. When this welding has been done, the tool 22 can be removed and the clamping force will be retained within the connection. Further welding can now be carried out on the collar and the process repeated at each connection point.

In the event of the liners 7 requiring to be removed after a period of service (this would normally be required only when there is a need to replace excessively worn liners with new liners), this would be achieved by burning off the thrust collars 20 or gouging out the remaining collar welds. While this may be regarded as more labour intensive than the removal of nuts it will not, in fact, be the case since experience has shown that even such nuts require to be burned off in a similar manner after a period of service.

Further advantages of this system over those based on the conventional welded stud (FIG. 4*a*) or countersunk bolt (FIG. 3) result from the fact that the welded collar 20 is, inherently, less susceptible to mechanical failure due to erosion since it would require most of the weld to be worn away before this could occur. By contrast, a bolted connection could fail when there is sufficient local wear to cause bursting of the nut. For this reason, it is most unlikely that any additional erosion protection (such as the cups shown in FIG. 3) would be required.

It should be noted that this principle could also be utilised using externally threaded connectors where the required clamping force could be equally well applied by a clamping tool suitably adapted to engage with such a thread. However, this would require the connector length to be increased and would leave the threaded portion protruding beyond the collar, thereby increasing flow interference on the underside of the blade. The thread size would also be significantly larger for the same diameter of connector unless it was stepped down to a smaller diameter at the thread, which would add significantly to the manufacturing cost of the connectors. For these reasons, the internally threaded connector sleeve is considered to be the preferred option.

However, it could also be achieved with some kind of threadless connector sleeve (e.g. a plain bore with an internal groove which could be engaged by a clamping tool).

This invention provides a method for attaching proprietary pre-hard surfaced liner material to impeller surfaces in such a way that the risks normally associated with prior art methods of achieving this are eliminated. In particular, it is compared with the welded stud method since that provided a comparable facility for site replacement of liners but had the inherent disadvantage of introducing parasitic bending stresses on to the stud weld, which could lead to failure of the connection. The invention allows the required clamping force to be provided without inducing such bending loads.

If desired the blades 6 may be provided with weight-reducing slots with or without any strip welding around the perimeter of the slots.

Although in the above the material of the backing plate 7*a* of the liner is simply referred to as steel, it is possible for other materials than steel to be used, and also when steel is used there is a whole range of steels, having varying hardness, from which the backing plate material can be chosen.

What is claimed is:

1. A combination comprising a rotor for a fluid machine and a clamping tool, said rotor comprising a plurality of blades, each with a blade body defining a front face and a rear face, a plurality of wear-resistant liners each having a backing plate, and a plurality of connector means connecting a respective said liner to each said blade, each said connector means comprising a connector sleeve having first and second ends and attached to the backing plate and having an internal thread, a thrust collar engaging the rear face of the blade body, and an attachment weld comprising at least two tack welds between the connector sleeve and the thrust collar and holding the thrust collar firmly against the rear face of the blade body, the clamping tool comprising a tubular body and a bolt having a head and a shank, the shank having a thread which engages the internal thread of the connector sleeve, said tubular body having at one end a recess to receive the second end of the connector sleeve and at the other end an abutment face against which clamping thrust can be applied by virtue of the head of the bolt.

2. A combination according to claim 1 characterised in that said rotor comprises a further weld comprising a continuous annular strip weld around the perimeter of the connector sleeve connecting the connector sleeve to the backing plate.

3. A combination according to either claim 1 or claim 2 characterised in that the said recess to receive the second end of the connector sleeve includes slots to provide access to the connector sleeve and the thrust collar for allowing manufacture of said tack welds.

4. A combination according to any one of claims 1 to 3 and including spherical washers to fit between the head of said bolt and the said abutment face of the tubular body for allowing misalignment of the bolt with respect to the longitudinal axis of the tubular body during screwing in of the clamping bolt.

5. A method of connecting a wear-resistant liner to a rotor blade of a fluid machine, said rotor blade having a fluid dynamic front face and non-fluid dynamic rear face, characterized by: forming a plurality of bores in said rotor blade;

attaching a plurality of connector sleeves to the wear-resistant liner at locations to come into register with said bores in the rotor blade when the wear-resistant liner is attached to the rotor blade and to have a portion projecting beyond said rotor blade;

pre-forming the liner to fit on the fluid dynamic surface of the rotor blade;

bringing the wear-resistant liner and the rotor blade into engagement and placing a thrust collar around the projecting portion of the connector sleeve at the non-fluid dynamic rear face of the rotor blade;

presenting a tubular clamping tool to said thrust collar and mounting it with respect to said connector sleeve so that the tool can be actuated to thrust the thrust collar firmly against the rear surface of the blade body;

applying tack welds between the connector sleeve and the thrust collar to hold the thrust collar in place relative to the connector sleeve; and, removing the clamping tool from the connector sleeve.

6. A method according to claim 5 characterised by including the further step of providing additional weld material between the thrust collar and the connector sleeve to mount the thrust collar more securely relative to the connector sleeve.

* * * * *